United States Patent [19]

Iannelli

[11] Patent Number: 4,462,220

[45] Date of Patent: Jul. 31, 1984

[54] COOLING SENSOR FOR REFRIGERATION SYSTEM

[75] Inventor: Frank M. Iannelli, Spartanburg, S.C.

[73] Assignee: Gerlach Industries, Spartanburg, S.C.

[21] Appl. No.: 486,253

[22] Filed: Apr. 18, 1983

Related U.S. Application Data

[63] Continuation-in-part of Ser. No. 316,873, Oct. 30, 1981.

[51] Int. Cl.[3] ..... F25D 17/02

[52] U.S. Cl. ..... 62/201; 374/116; 165/163

[58] Field of Search ..... 62/201, 185, 59, 399; 374/116; 165/163

[56] References Cited

U.S. PATENT DOCUMENTS

| | | | |
|---|---|---|---|
| 2,039,556 | 5/1936 | Ruse . | |
| 2,470,936 | 5/1949 | Lo Gerfo | 62/392 X |
| 2,888,251 | 5/1959 | Dalin | 165/163 X |
| 3,056,273 | 10/1962 | Cornelius | 62/393 |
| 3,111,846 | 11/1963 | Willer, Jr. et al. | 374/116 |
| 3,263,442 | 8/1966 | Timmersman | 62/399 X |

*Primary Examiner*—William E. Wayner
*Attorney, Agent, or Firm*—Julian W. Dority

[57] ABSTRACT

A refrigeration system for cooling a beverage as the beverage is drawn from a container filled with water which has an evaporator coil carried adjacent the wall thereof which extends from adjacent the top of the container to the bottom of the container. When a refrigerant is circulated through the evaporator coil, an ice bank is built up on the inner wall of the container. A beverage dispensing coil is centrally located with the container and is connected between a faucet and the container from which the beverage is to be drawn. A helical support coil extends from adjacent the top of the container to the bottom and encircles the beverage dispensing coil. A temperature sensor is threaded inside the helical copper support coil so that any time the ice bank builds up closely adjacent thereto, it will turn off the compressor. A motor driven power paddle is used for circulating the water within the container.

3 Claims, 3 Drawing Figures

COOLING SENSOR FOR REFRIGERATION SYSTEM

This application is a continuation-in-part application of application Ser. No. 06/316,873 filed on Oct. 30, 1981, entitled Beverage Cooling Device.

BACKGROUND OF THE INVENTION

Heretofore, normally kegs of beer have to be refrigerated from the time they leave the brewery until they are used in order to avoid spoiling of the beer. This requires refrigerated trucks for transporting the kegs of beer from the brewery to a refrigerated storage warehouse and refrigerated trucks for distributing the kegs to the ultimate users. The cooled kegs of beer are then stored in a refrigerated storage area at the establishment where they are ultimately to be used and, as they are used, they must be maintained in a refrigerated cabinet. As can be seen, such is an expensive and cumbersome way of dispensing tap beer. Recently, however, breweries have begun pasteurizing beer placed in kegs and, as a result, the beer does not have to be refrigerated. However, the beer has to be cooled prior to being consumed.

Normally, wine is shipped to the establishments where it is ultimately to be served in an unrefrigerated plastic container. These containers normally have to be refrigerated prior to use.

Attempts have been made to provide beverage dispensers which are capable of cooling the beverage as it passes between a keg and a dispensing faucet. One such device is disclosed in U.S. Pat. No. 3,056,273. Other devices are disclosed in U.S. Pat. Nos. 2,470,936, 3,263,442, and 2,039,556.

While the device disclosed in U.S. Pat. No. 3,056,273 does disclose a beverage dispenser that is capable of cooling the beverage as it is drawn from a warm container, no details of the control utilized with the apparatus for controlling the thickness of an ice bank provided therein is disclosed.

SUMMARY OF THE INVENTION

This invention relates to an apparatus for cooling a beverage, such as wine or beer as it is removed from a container and dispensed. The apparatus includes a container having a vertically extending wall and a top and bottom. Water is carried in the container and is cooled by an evaporator coil carried adjacent the wall of the container which extends vertically from adjacent the top of the container to adjacent the bottom of the container. A refrigeration condensing means circulates a refrigerant through the evaporator coil, cooling the water carried in the container, and building an ice bank up along the inner wall of the container. A beverage dispensing coil is centrally carried within the container and extends substantially vertically from adjacent the top of the container to the bottom of the container. The beverage dispensing coil has a predetermined outside diameter so as to provide a space between the inside wall of the container and the beverage dispensing wall for allowing the bank of ice to build up on the inside wall without touching the beverage dispensing coil. A helical support coil is supported on brackets carried by the beverage dispensing coil and encompasses the beverage dispensing coil. The helical support coil encircles the beverage dispensing coil and extends into the space provided between the beverage dispensing coil and the ice bank. A temperature sensor is carried within the helical coil for activating the refrigeration condenser device responsive to the ice bank building up closely adjacent any portion of the helical support tube. A paddle wheel is centrally located within the beverage dispensing coil for circulating the water within the container.

The helical support coil, in one particular embodiment, is constructed of copper tubing which transfers heat readily. As a result, if the ice bank builds up to such an extent at any place along the inner wall of the container and touches the copper tubing, this temperature condition is immediately sensed by the temperature sensor to cut off the compressor associated with the refrigeration condensing device. It is desired that the water provided in the container be maintained at approximately 33° to 34° F.

Accordingly, it is an important object of the present invention to provide a simple and effective apparatus for cooling beverages such as wine coming from a container as it is dispensed.

Another important object of the present invention is to provide a control system for a refrigeration device utilized in a beverage dispensing device that ensures a uniform thickness of buildup of ice on the interior wall of the container.

Another important object of the present invention is to provide an efficient, simple and reliable device that can be readily installed on the tops of conventional cabinets for cooling beer or wine as it is being dispensed.

These and other objects and advantages of the invention will become apparent upon reference to the following specification, attendant claims, and drawings.

DESCRIPTION OF A PREFERRED EMBODIMENT

Figure 1:
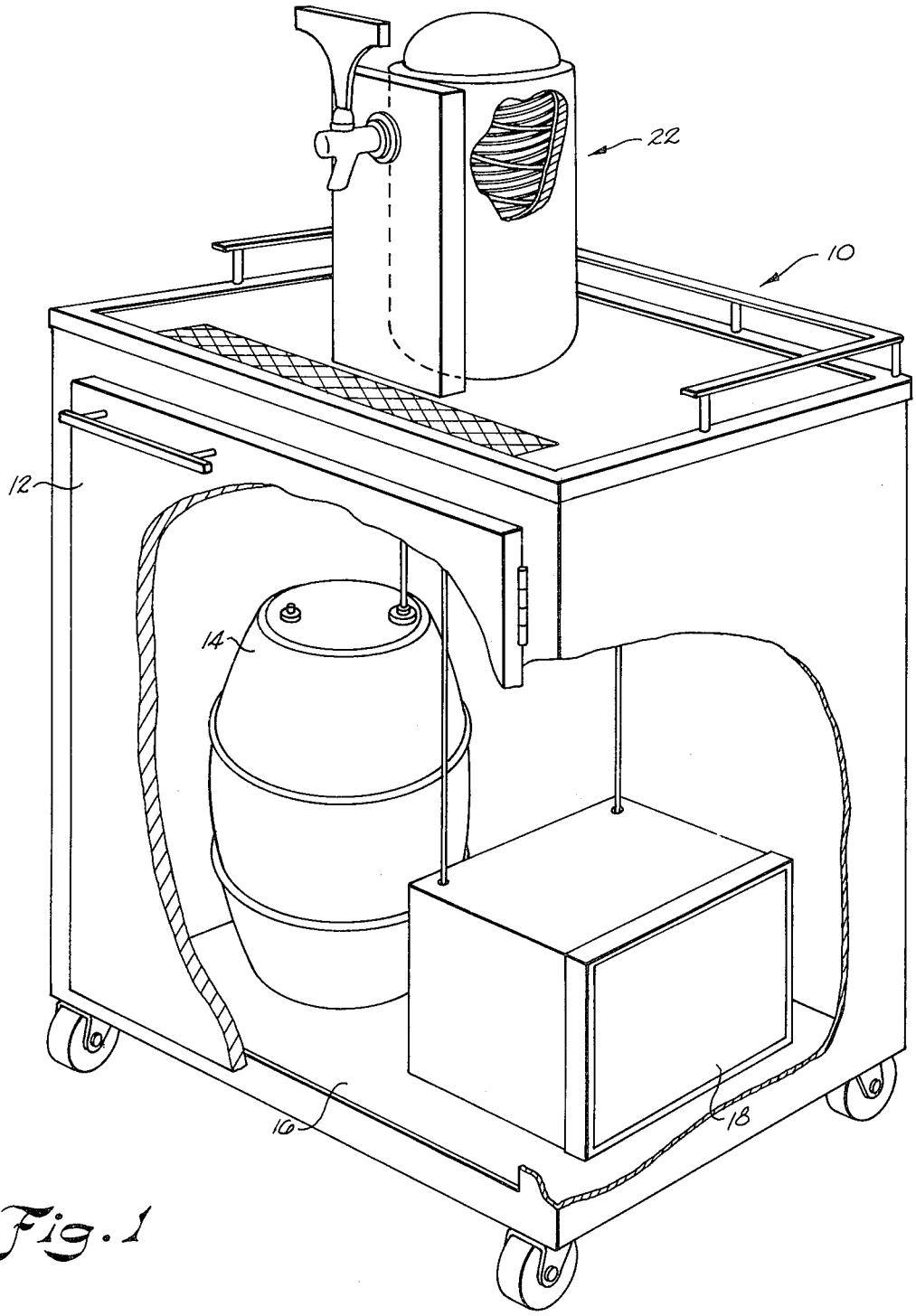
FIG. 1 is a perspective view with parts broken away showing a refrigeration system for cooling beer and the like as it is dispensed from a keg.

Referring to FIG. 1 of the drawing, there is disclosed a cabinet generally designated by the reference character 10 which has a door 12 provided on the front thereof for permitting access to the interior. A keg 14 of beer is positioned within the cabinet and supported on a bottom 16. It is understood, of course, that instead of a keg being positioned in the cabinet, packages of wine could also be positioned therein and dispensed therefrom. Also positioned within the cabinet is a refrigeration condensing means 18 which may be of any suitable conventional construction.

Extending outwardly from the refrigeration condensing means 18 is a capillary tube 20 through which a refrigerant flows up to a container 22 carried on top of the cabinet. The container 22 is provided for cooling the beer as it flows from the keg 14 to a conventional ON/-OFF faucet 24. The container includes a cylindrical side wall 26 that is joined by a bottom wall 28 and a top 30. The top 30 has a cylindrical opening therein for receiving a cap 32 that has a motor 34 provided therein. Extending downwardly from the motor 34 is a shaft 35 which has a paddle 36 connected to the lower end thereof. In order to gently circulate the water within the container, the paddle extends from adjacent the top of the shaft to adjacent the bottom.

An evaporator coil 38 is carried within the inside wall of the container and extends vertically upwardly from adjacent the bottom of the container to the top. The bottom of the evaporator 38 coil is connected directly to the capillary tube 20 extending from the compressor 18. The other end of the evaporator coil 38 is connected to the compressor 18.

Insulation 40 is provided between the inner wall 26 of the container and the exterior wall 41.

Figure 2:
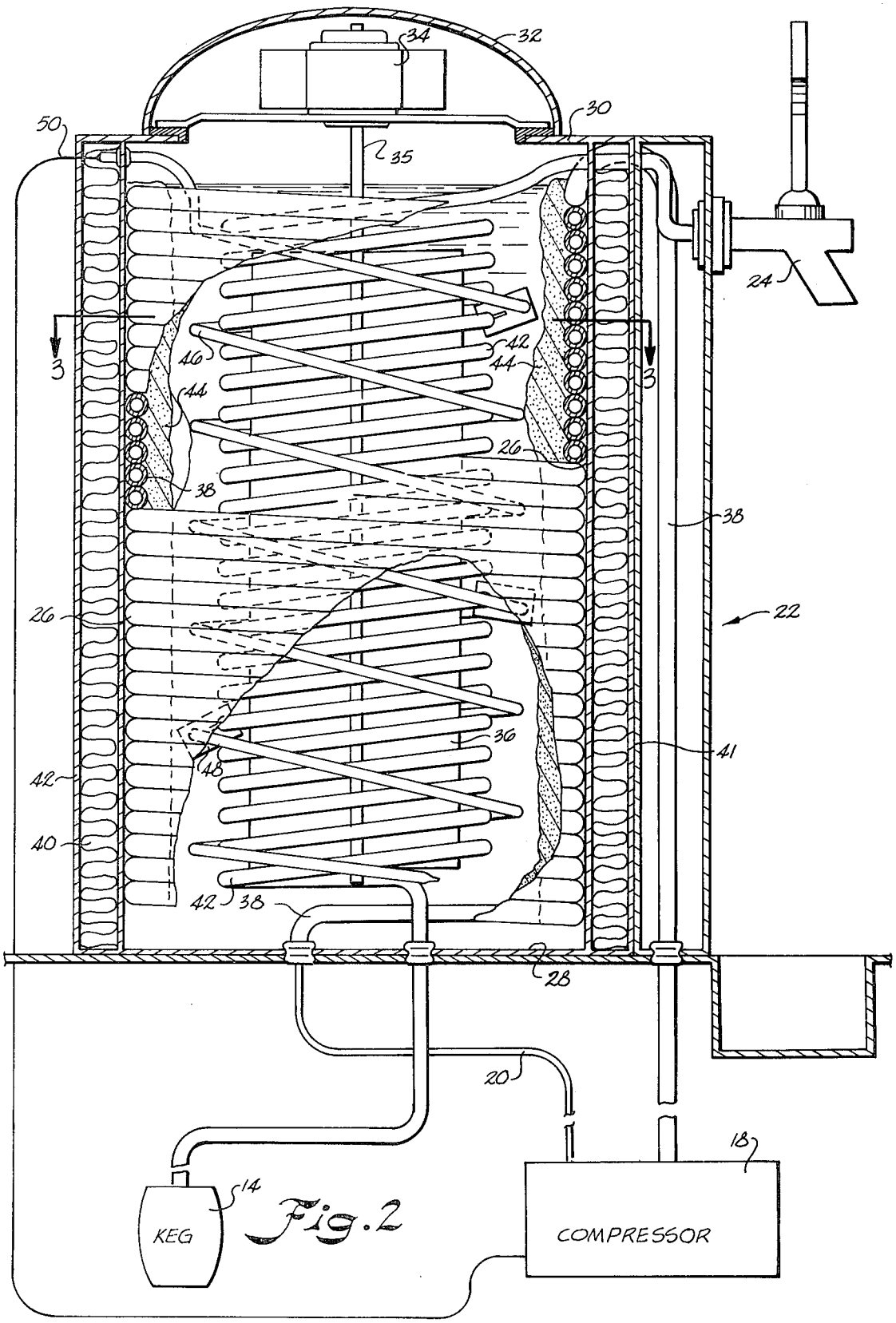
FIG. 2 is an enlarged sectional view of the refrigeration apparatus.
Figure 3:
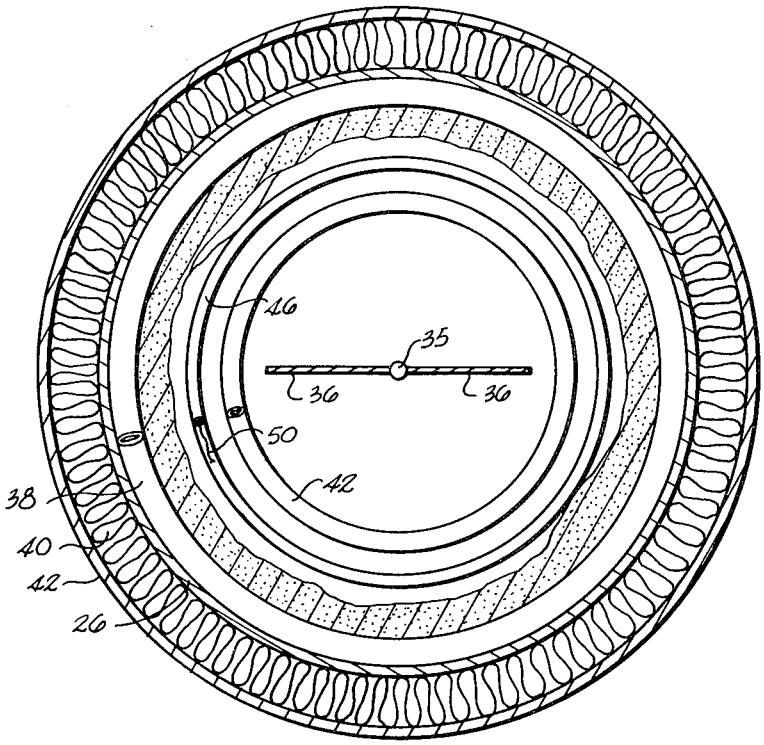
FIG. 3 is a cross sectional view taken along line 3—3 of FIG. 2.

The interior of the container is filled with water to a level closely adjacent the top of the container directly above the upper coil of the evaporator coil 38. A beverage dispensing coil 42 is centrally carried within the container and extends vertically from adjacent the bottom of the container to adjacent the top of the container. The lower end of the beverage dispensing coil is connected by means of a tube 45 to the pressurizzed keg 14. The upper end of the beverage dispensing coil is, in turn, connected to the faucet 24. It is noted that the paddle 36 is centrally located within the beverage dispensing coil. The beverage dispensing coil 42 has an outside diameter which is less than the diameter of the container so as to provide a space between the evaporator coil 38 and the beverage dispensing coil 42. This space should be sufficient to allow a buildup of ice such as shown by the reference character 44 around the evaporator coil. This buildup of ice generally extends from the bottom of the container closely adjacent the top. A helical tube 46 is supported on brackets 48 and extends from adjacent the top of the container to adjacent the bottom and also encircles the beverage dispensing coil 42. The brackets 48 are supported on the beverage dispensing coil 42 and maintain the helical tube 46 spaced therefrom. As can be seen in FIG. 2, the helical tube is positioned in the container between the ice bank 44 and the beverage dispensing coil 42. Inserted within the helical tube which, in one particular embodiment, is a copper tube, is a temperature sensing probe, the end of which is connected by lead 50 to the compressor 18. As a result, if at any time the buldup of ice touches the copper tube 46, it will immediately cut the compressor 18 off since the temperatuer sensor probe is in heat transfer relation with the entire length of the copper tube 46. In one particular embodiment, the temperature sensor probe is approximately six fee long with five feet extending into the copper tube 46 and one foot extending out the end thereof.

In operation, once the keg 14 is connected up to the tube 45, when the faucet 24 is opened, the warm beer or wine from the keg 14 flows up through the cooling tube 42 and is cooled to approximately 34° F. prior to flowing out of the faucet 24. As a result of the elongated paddle 35 rotating, the water within the container is gently and evenly circulated bringing it in contact with the layer of ice built up on the side of the container and the dispensing coil 42. It is important that the buildup of ice does not touch the cooling tube 42 since it would freeze the beer or wine carried in the dispensing coil. The temperature sensor carried within the helical tube 42 ensures that the water between the layer of ice 44 and the dispensing coil 42 remains above freezing by selectively turning on and off the compressor 18.

While a preferred embodiment of the invention has been shown, such description is for illustrative purposes only, and it is to be understood that changes and variations may be made without departing from the spirit or scope of the following claims.

What is claimed is:

1. A refrigeration system for cooling a beverage as said beverage is drawn from a container comprising:

a container having a vertically extending wall and a top and a bottom, water carried in said container, an evaporator coil carried adjacent the wall of said container extending vertically from adjacent the bottom of said container to adjacent the top of said container;

refrigeration condensing means circulating a refrigerant through said evaporator coil cooling said water carried in said container and bulding an ice bank along the inner wall of said container;

a vertically extending beverage dispensing coil centrally carried within said container;

said beverage dispensing coil having a predetermined outside diameter so as to provide a space between said inside wall of said container and said beverage dispensing coil for allowing said bank of ice to build up on said inside wall without touching said beverage dispensing coil;

a helical support coil extending from adjacent the top of said container to adjacent the bottom, said helical support coil encircling said beverage dispensing coil and extending into said space provided between said beverage dispensing coil and said ice bank, and a temperature sensor carried within said helical coil for activating said refrigeration condensing means responsive to said ice bank building up closely adjacent any portion of said helical support tube.

2. The refrigeration system as set forth in claim 1 further comprising:

said helical support coil being a copper tube into which said temperature sensor is inserted.

3. The refrigeration system as set forth in claim 1 further comprising:

brackets spaced around said beverage dispensing coil supporting said helical support coil.

* * * * *